United States Patent [19]

Bummer

[11] Patent Number: 4,550,804

[45] Date of Patent: Nov. 5, 1985

[54] CLIMBING ASSIST APPARATUS HAVING CONTROLLED DESCENT AND ESCAPE MECHANISM

[76] Inventor: Bruce L. Bummer, 5017 Alcova Rte., P.O. Box 56, Casper, Wyo. 82604

[21] Appl. No.: 580,523

[22] Filed: Feb. 15, 1984

[51] Int. Cl.[4] ..... A62B 35/02; A62B 1/12

[52] U.S. Cl. ..... 182/233; 182/8; 182/10

[58] Field of Search ..... 182/10, 8, 233, 238, 182/75

[56] References Cited

U.S. PATENT DOCUMENTS

| | | | |
|---|---|---|---|
| 1,571,096 | 1/1926 | Rambin et al. | 182/10 |
| 1,849,725 | 3/1932 | Quick | 182/10 |
| 2,538,904 | 1/1951 | Herod | 182/8 |
| 2,670,890 | 3/1954 | Hodge | 182/10 |
| 2,948,348 | 8/1960 | Bott | 182/11 |
| 3,261,590 | 7/1966 | Bech | 182/238 |
| 3,826,335 | 7/1974 | Allen | 182/10 |
| 4,252,214 | 2/1981 | Miller | 182/8 |
| 4,442,918 | 4/1984 | Rhoads | 182/10 |
| 4,458,781 | 7/1984 | Ellis | 182/8 |

*Primary Examiner*—Reinaldo P. Machado
*Attorney, Agent, or Firm*—John E. Reilly

[57] ABSTRACT

A climbing assist apparatus for oil derricks and the like comprises a cable which is attached to the worker and is trained over a sheave at the crown portion of the rig, then connected to a counterweight in order to remove slack from the cable as the worker is climbing. The sheave is keyed to a motor drive shaft which is free wheeling in one direction of rotation in response to advancement of the cable as the workman is climbing but will impose a controlled resistance in the opposite direction, this resistance being established through a hydraulic motor for the drive shaft and a hydraulic control circuit which includes a flow controller to resist the rotation of the motor in the opposite direction to that earlier described when the worker descends or should accidentally fall from the derrick.

9 Claims, 4 Drawing Figures

CLIMBING ASSIST APPARATUS HAVING CONTROLLED DESCENT AND ESCAPE MECHANISM

This invention relates to climbing assist apparatus and more particularly relates to a novel and improved apparatus to assist personnel in climbing ladders and to safely control their rate of descent either in the event of an accidental fall or in escaping from the vicinity of the ladder.

BACKGROUND AND FIELD OF THE INVENTION

Various climbing assist devices are used to assist personnel in climbing ladders over extended distances and to assure their safety in the event of a fall. Oil derricks and work-over rigs present special problems in protecting against injury resulting from falls not only by virtue of the distance over which personnel are required to climb, oftentimes with the additional weight of tools and accessories, but as a result of adverse weather conditions and other natural hazards associated with that work. Typically, apparatus which is presently in use includes a counterweight to assist personnel in climbing to the desired height together with means to control their descent or escape particularly if one should accidentally slip or fall from the ladder. It has been proposed in the past to employ hydraulic cylinders positioned alongside of the derrick or climbing structures to serve as a retarding means in the event of a fall. However, these cylinders can be easily damaged and rendered inoperable, for example, in the event of a dent in the cylinder which will prevent it from performing properly. Hydraulic cylinders further are not capable of controlling the descent of personnel at a constant speed irrespective of the weight of the personnel. In other words, unless the descent control apparatus is capable of establishing a controlled rate of descent independently of the weight of the person, severe limitations are placed on its use by different weight persons.

Representative of approaches taken in the past are those disclosed in U.S. Pat. No. 4,252,214 to Miller which employs a hydraulic cylinder as a means of controlling descent. U.S. Pat. No. 2,948,348 to Bott as well as U.S. Pat. No. 2,538,904 to Herod disclose derrick or ladder safety devices in which counterbalancing mechanisms are employed in combination with descent control apparatus. Other representative patents are U.S. Pat. Nos. 1,571,096 to L. G. Rambin et al; 1,849,725 to D. E. Quick; 2,670,890 to S. P. Hodge; and 3,826,335 to M. F. Allen.

SUMMARY OF INVENTION

It is therefore an object of the present invention to provide for a novel and improved climbing assist apparatus specifically adaptable for use in connection with oil derricks, rigs and the like.

It is another object of the present invention to provide for a novel and improved climbing assist apparatus which is durable, compact and highly efficient and reliable in operation.

It is an additional object of the present invention to provide in a climbing assist apparatus for a novel and improved descent control or arrest mechanism which is capable of controlling the descent of a person at a predetermined rate of speed independently of the person's weight and distance over which the person is required to descend.

It is yet another object of the present invention to provide in a climbing assist apparatus for a novel and improved arrangement of a counterweight and descent control mechanism which is adaptable for use in derricks or rigs both as a descent control and escape mechanism.

In accordance with the present invention, there has been devised a climbing assist apparatus specifically adapted for use on oil derricks and rigs wherein a cable which is attached to the personnel climbing the rig is trained over a sheave at an elevated position on the rig and connected to a counterweight so as to remove any slack in the cable as the workman is climbing. Positive displacement motor drive means includes a motor drive shaft keyed to the sheave and which drive shaft is free-wheeling or freely rotatable in one direction of rotation in response to the advancement of the cable over the sheave as the workman is climbing but will impose controlled resistance in the opposite direction. This resistance is established through a hydraulic control circuit including a pressure-compensated, constant rate flow controller associated with the drive motor and which will impose a predetermined resistance to rotation of the motor in an opposite direction in response to the application of force via the cable when the worker descends the ladder or derrick. Thus, in the event of a fall, the pressure-compensated flow controller will impose a selected resistance to the fluid flow through the motor so as to regulate the descent of the worker at a predetermined rate.

The positive displacement motor drive and flow rate controller are preferably mounted at the crown of the rig within a common housing, and an arrangement of sheaves is positioned externally of the housing, one of the sheaves keyed for rotation upon the motor drive shaft projecting from one wall of the housing. Auxiliary sheaves are provided in cooperation with the main sheave to guide the cable over the main sheave so as to assure maximum contact and prevent any slippage, particularly in the event of sudden application of forces to the cable.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
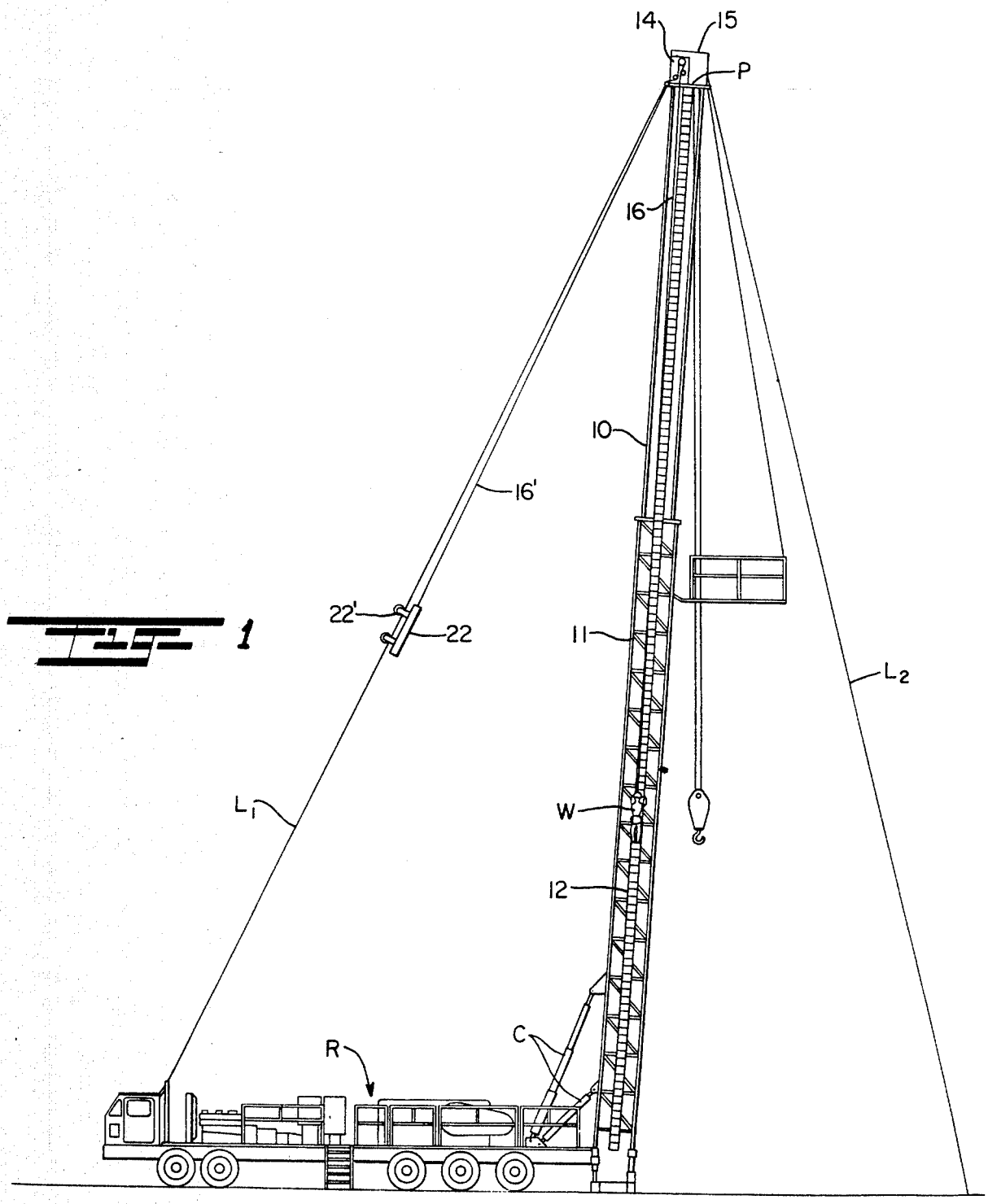
FIG. 1 a side elevational view of a vehicle-mounted rig upon which the apparatus of the present invention is mounted.

Referring in detail to the drawings, there is illustrated in FIG. 1 a conventional work-over rig R positioned at one end of a vehicle P and supported in position by means of standard hydraulic cylinders C together with guylines $L_1$ and $L_2$. Typically, the guyline $L_1$ is anchored to the front portion of the vehicle and one or more guylines $L_2$ are anchored to the ground. The upper ends of the guylines $L_1$ and $L_2$ are suitably anchored to the crown or upper platform P of the rig. Conventionally, the rig or derrick R comprises upper and lower telescoping sections 10 and 11, and a ladder 12 is mounted for extension from ground level up to the crown of the derrick as shown. Normally, the ladder 12 is mounted on the off-operator side, or left side of the derrick, as viewed from the front of the vehicle. However, for the purpose of illustration and to better illustrate its relationship to the entire rig is shown in FIG. 1 as being on the operator side.

Figure 2:
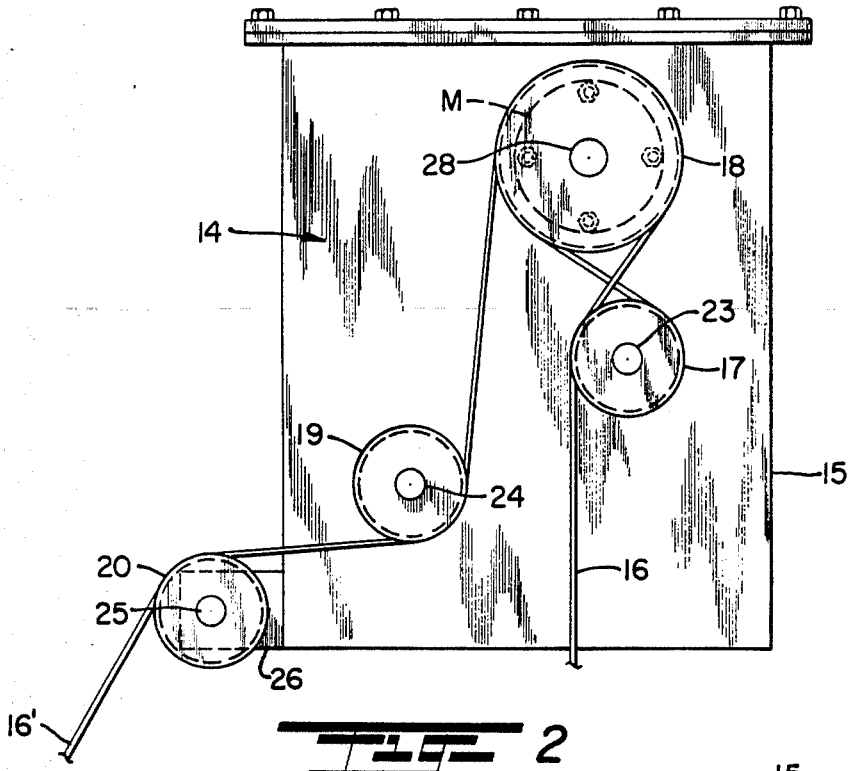
FIG. 2 is an enlarged view partially in section of a preferred form of pulley system and motor drive mounted on the crown of the rig illustrated in FIG. 1.
Figure 3:
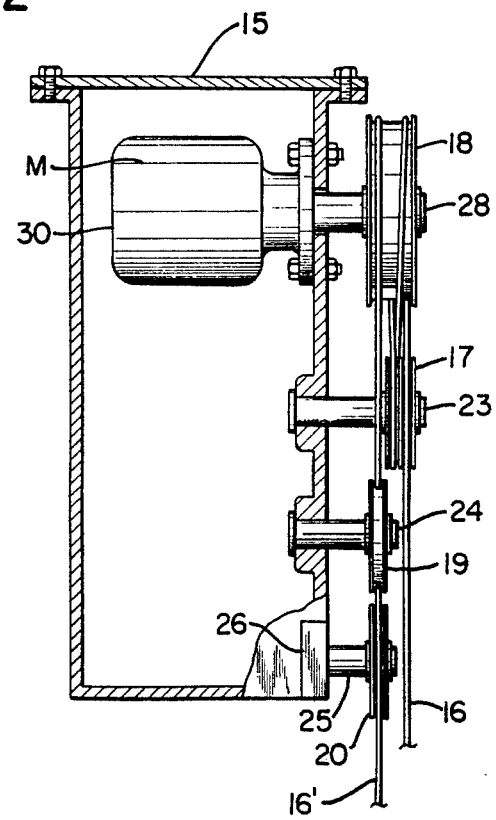
FIG. 3 is a cross-sectional view of the pulley system and motor drive illustrated in FIG. 2.

In accordance with the present invention, a preferred form of climbing assist apparatus comprises a pulley system generally designated at 14 which is mounted in housing 15 on the crown of the rig R. As shown in FIGS. 1 to 3, a cable 16 passes upwardly from connection to the worker W, as represented on the ladder 12, along one side of a lower sheave or pulley 17 then is wrapped for almost 360° around an upper main sheave 18 followed by returning around the lower sheave 17 and passing upwardly a second time around the main sheave 18, after which it is passed around the lower side of a second lower sheave 19 and the upper side of a third sheave 20, then angles downwardly as at 16'. The lower terminal end of the length 16', as illustrated in FIG. 1, has counterweight 22 which is slidingly connected by a pulley block 22' to the guyline $L_1$. The housing 15 is of generally rectangular configuration and the lower sheaves 17 and 19 are journaled on stub shafts 23 and 24, respectively, projecting from the wall of the housing 15. The sheave 20 is journaled on a shaft 25 mounted on an extension bracket 26 which may project either from one side of the housing or be mounted on the crown P of the rig. The main or upper sheave 18 may either be a double sheave as illustrated to accommodate the two turns of cable wrapped around it, or in the alternative may be comprised of a pair of sheaves. In either case, the main sheave is keyed for rotation on motor drive shaft 28 projecting through the wall of the housing from a hydraulic motor drive 30 which is mounted within the housing 15.

The lower terminal end of the cable 16 is suitably secured to the worker W by any means, such as, a strap or harness which encircles the waist or upper torso of the worker. In climbing the ladder, any slack in the cable is taken up by means of the counterbalance 22 sliding downwardly along the guyline $L_1$. As the counterbalance slides downwardly, the cable will of course impart rotation to the motor drive shaft 28. In a manner to be hereinafter described, however, the motor drive is free-wheeling in one direction so that the cable is free to travel around the pulley system under the weight of the counterbalance as the worker climbs the ladder.

Figure 4:
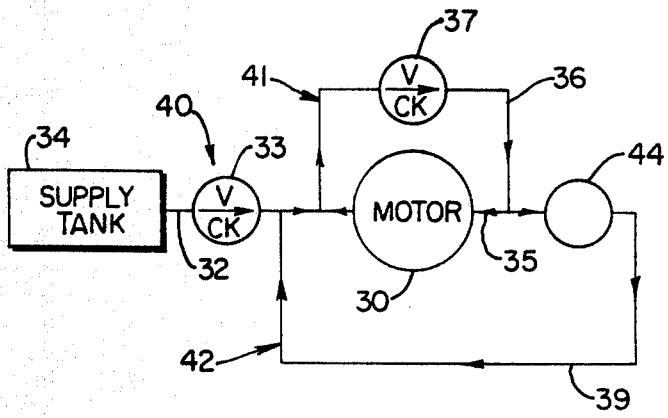
FIG. 4 is a schematic diagram of the hydraulic control circuit employed in conjunction with the drive motor illustrated in FIGS. 2 and 3.

As shown in FIG. 4, a preferred form of hydraulic control circuit, as represented at 40, includes the hydraulic motor 30 and has a main delivery line 32 with a check valve 33 therein extending from a source of hydraulic fluid under pressure as represented at 34. The line 32 supplies fluid to first and second control circuits 41 and 42 communicating via a common fluid line 35 with opposite sides of the hydraulic drive motor 30. The first circuit 41 has a fluid line 36 which communicates with the line 35 on opposite sides of the motor 30 and has a check valve 37 in the line 36. The second circuit 42 includes a separate fluid line 39 which extends through a pressure-compensated flow controller 44 and is connected into the common line 35 on opposite sides of the motor 30 as shown. Preferably, the hydraulic motor drive is a Model M25X897DEXX15, made by Commercial Shearing, Inc., of Youngstown, Ohio, and the pressure-compensated flow controller 36 is a Model FRI-15N4-P45, manufactured and sold by Snap-Tite, Inc. of Erie, Pennsylvania. As seen from FIG. 4, check valve 33 will permit fluid to be delivered from the supply source into the control circuit and will periodically supply make-up fluid as required to maintain the desired pressure level in the circuit; however, the check valve will prevent fluid from returning into the supply source from the circuit. The first and second control circuits 41 and 42 as described define two separate circuits which will function independently of one another, depending upon the direction of rotation of the motor 30 in response to movement of the cable about the main pulley 18. Thus, when the motor is rotated in a clockwise direction, as viewed in FIG. 4, fluid is driven under pressure in a clockwise direction through the first circuit and specifically the line 36 via check valve 37 and back through common line 35 into the opposite side of the motor. This condition would obtain, for example, when the worker is climbing the ladder and the cable is caused to advance under the weight of the counterbalance 22 so as to take up any slack in the cable and assist the worker in climbing the ladder, the fluid being free to flow through the first circuit path via the line 36 and not impose any resistance to rotation of the motor. When the motor is rotated in a counterclockwise direction in response to the worker descending the ladder, the fluid is caused to flow through the second circuit 42 and in the direction of the lower arrows as indicated through the line 39 and common line 35. In this direction of rotation, the check valve 37 will prevent flow through the upper or first circuit, and the flow controller 44 will impose a predetermined resistance to fluid flow from the motor and in this way impose a predetermined resistance to rotation of the hydraulic motor dependent upon the pressure setting of the flow controller 44. For example, the illustrative flow controller referred to above can withstand up to a maximum pressure of 10,000 psi and maintain a constant rate of flow of 4.5 independently of the force or moment applied as a result of a worker falling from the ladder and to limit his descent to a predetermined rate.

From the foregoing, it will be appreciated that the motor drive and controller circuit is compact and highly efficient in controlling the descent of the worker at a constant rate of speed independently of the weight applied. Conversely, the motor drive as described will offer little or no resistance to fluid flow through the first circuit 41 and permit the counterweight to take up any slack in the cable. As a result, a lightweight counterweight can be used so as to make controlled descent much easier when the worker is descending the ladder. The apparatus as described can be employed as an escape mechanism to permit a worker to transfer himself from the ladder over to a separate guyline, such as, one of the guylines $L_2$ should it be necessary to transport himself away from the immediate vicinity of the derrick. Here, it is necessary only for the worker to swing himself from the ladder over to one of the guylines or to a separate escape line and by suitable attachment of the cable to that line ride down the line at a controlled rate as regulated by the motor and control circuit. Where a separate escape line is employed and extends a greater distance away from the derrick than the guylines it may be necessary to employ a longer cable in place of the guyline $L_1$ for attachment of the counterweight 22.

It is therefore to be understood that various modifications and changes may be made in the specific construction and arrangement of parts comprising the present invention without departing from the spirit and scope thereof as defined by the appended claims.

I claim:

1. In climbing assist apparatus adapted for use in climbing a ladder on a derrick and the like wherein a cable is attached to a worker climbing the ladder, said cable being trained over a sheave mounted at the upper end of said ladder and said cable passing downwardly and connected to counterweight means to remove any slack in said cable as the worker is climbing the ladder, the improvement comprising:

positive displacement motor drive means including a motor drive shaft keyed to said sheave, said motor drive means being freely rotatable in one direction of rotation in response to advancement of said cable over said sheave as the worker is climbing said ladder; and a hydraulic fluid circuit including flow controller means in said circuit applying a predetermined resistance to rotation of said motor drive in response to the application of force by said cable to said motor drive shaft in a direction opposite to the one direction whereby to control the rate of descent of the worker in the event of a fall or escape from the ladder.

2. In a climbing assist apparatus according to claim 1, said flow controller means characterized by being a pressure compensated flow controller.

3. In a climbing assist apparatus according to claim 1, said sheave being a double sheave, and said cable being passed around said sheave a plurality of turns in order to prevent slippage between said cable and said sheave in response to the application of a force in either direction to said cable.

4. In a climbing assist apparatus according to claim 3, including a second sheave, and said cable being successively wrapped about said main sheave in a first turn, partially around said second sheave in a second turn followed by a partial wrap around said main sheave in a third turn.

5. In a climbing assist apparatus according to claim 4, including third and fourth sheaves, said cable advancing from the third turn around said main sheave across said third and fourth sheaves, then angling downwardly and terminating in a counterweight, and means for slidably connecting said counterweight to said guylines.

6. In a fall prevention apparatus for a worker in climbing a ladder on a derrick or the like, said derrick having a crown at the top and means to anchor said derrick in an upright position, the improvement comprising:

a cable member secured to said worker;

motor-driven pulley means mounted on said crown, said pulley means including a positive-displacement reversible hydraulic motor and a drive shaft thereon, a pulley mounted for rotation on said drive shaft, said cable passing upwardly around said pulley and extending downwardly therefrom;

counterbalance means secured to said pulley on said downwardly extending portion of said cable on a side of said pulley opposite to said one end of said cable which is secured to said worker; and a hydraulic control circuit for supplying hydraulic fluid under pressure to said motor including first control circuit means establishing free flow of hydraulic fluid to and from said motor whereby said pulley means is freely rotatable in one direction of rotation in response to the ascension of said worker on said ladder, and second control circuit means including a flow controller establishing a separate path of fluid flow to and from said motor whereby to apply predetermined resistance to rotation of said motor in the opposite direction in response to the descent or fall of said worker.

7. In the fall prevention apparatus according to claim 6, said hydraulic motor having interchangeable intake and discharge ports and a common fluid line extending from said intake and discharge ports in communication with each of said first and second control circuit means.

8. In the fall prevention apparatus according to claim 7, said first control circuit means including a check valve to prevent fluid flow to said first control circuit means when said motor is rotated in said opposite direction.

9. In the fall prevention apparatus according to claim 6, said pulley defined by a double sheave, and a second pulley defined by a double sheave mounted for rotation independently of said motor, said cable being wrapped successively about said first pulley and said second pulley and wrapped again about said first pulley whereby to prevent slippage between said cable and said pulleys in response to the application of force in either direction of rotation to said pulleys.

* * * * *